US005957566A

United States Patent [19]

Chiu

[11] Patent Number: 5,957,566

[45] Date of Patent: Sep. 28, 1999

[54] FLASHLIGHT

[76] Inventor: Si Fu Chiu, Unit 10, 19th Floor, Technology Plaza, 29-35 Sha Tsui Road, Tsuen Wan, New Territories, The Hong Kong Special Administrative Region of the People's Republic of China

[21] Appl. No.: 08/938,710

[22] Filed: Sep. 26, 1997

[51] Int. Cl.[6] ..... F21L 15/08

[52] U.S. Cl. ..... 362/190; 362/186; 362/205

[58] Field of Search ..... 362/102, 122, 362/186, 190, 191, 205, 208, 577

[56] References Cited

U.S. PATENT DOCUMENTS

| | | | |
|---|---|---|---|
| 1,479,860 | 1/1924 | Lewis | 362/186 |
| 2,549,627 | 4/1951 | Musch et al. | 362/102 |
| 3,383,675 | 5/1968 | Allardice et al. | 362/186 |
| 3,559,224 | 2/1971 | Shimizu | 362/158 |
| 5,091,833 | 2/1992 | Paniaguas et al. | 362/208 |
| 5,400,008 | 3/1995 | Toohey | 362/158 |
| 5,526,243 | 6/1996 | Masters | 362/122 |

*Primary Examiner*—Alan Cariaso
*Attorney, Agent, or Firm*—Leydig, Voit & Mayer, Ltd.

[57] ABSTRACT

A flashlight includes a barrel for containing a battery cell and having front and rear ends, a light bulb supported at the barrel front end, a head cap connected to the barrel front end for covering the light bulb, and a tail piece connected to the barrel rear end. The tail piece has an outer shape converging backwards to form a substantially pointed end such that the flashlight may be planted or stuck into a penetratable supporting surface for standing on its own.

10 Claims, 2 Drawing Sheets

FLASHLIGHT

SUMMARY OF THE INVENTION

According to the invention, there is provided a flashlight comprising a elongate body for containing a battery cell and having front and rear ends, a light bulb supported at the body front end, a head piece connected to the body front end for covering the light bulb, and a tail piece connected to the body rear end, the tail piece having an outer shape converging backwards to form a substantially pointed end such that the flashlight may be planted or stuck into a penetratable supporting surface for standing on its own.

Preferably, the tail piece has a substantially conical outer shape.

Preferably, the tail piece and the body rear end have a smooth overall outer shape.

More preferably, the tail piece, the body and the head piece have a smooth overall outer shape.

In a preferred embodiment, the flashlight includes a shade for surrounding the light bulb.

More preferably, the shade is adapted to be connected to the body front end while the head piece is removed.

It is further preferred that the shade be adapted to be fitted by friction over the body front end.

Preferably, the shade has a transparent or translucent wall having a surface formed to diffuse the light of the light bulb.

More preferably, the surface of the shade is serrated.

In a preferred embodiment, the flashlight includes a control unit incorporating an electronic control circuit for switching the light bulb on and off to flash.

Preferably, the control unit is in the form of an add-on section for use between the body and the tail piece.

More preferably, the control circuit has opposite terminals for ready electrical connection into the power supply circuit of the light bulb between the body and the tail piece on opposite sides.

It is preferred that the control unit have an outer shape and size matching with those of the body and tail piece on opposite sides.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 1:
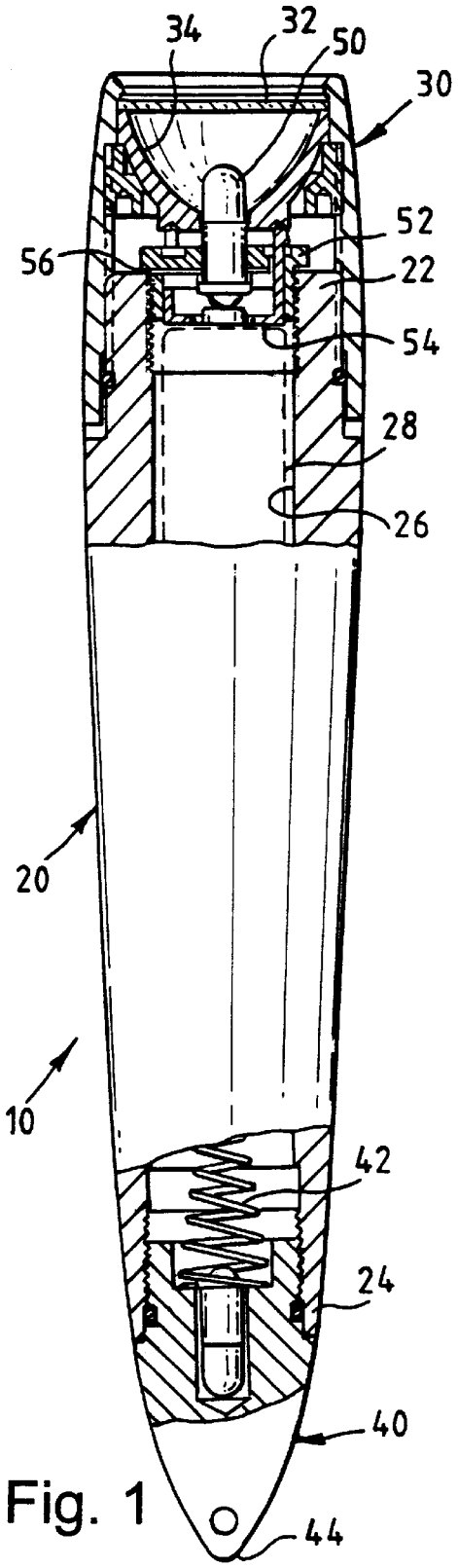
FIG. 1 is a cross-sectional-side view of an embodiment of a flashlight in accordance with the invention, said flashlight having a head-piece.

Referring firstly to FIG. 1 of the drawings, there is shown a flashlight 10 embodying the invention, which comprises an aluminium body barrel 20 having open front and rear ends 22 and 24. The flashlight 10 includes a head cap 30 and a tail piece 40, both of aluminium, screwed to the barrel ends 22 and 24 respectively. The head cap 30 is provided with a front glass plate 32 and an internal cup reflector 34. A light bulb 50 is located at the center of the barrel front end 22 by means of co-axial front and rear plastic caps 52 and 54. The front cap 52 is screwed partially into the barrel front end 22 and has a central aperture through which the light bulb 50 extends outwards and stays there by friction. An apertured conductive disc 56 is provided on the rear side of the front cap 52 for electrically connecting the body terminal of the light bulb 50 to the barrel front end 22. The rear cap 54 is snap-fitted with and movable back-and-forth relative to the front cap 52 and has a central aperture to permit access to the end terminal of the light bulb 50.

The barrel 20 defines a battery compartment 26 for containing a series of two battery cells 28. The tail piece 40 is provided with a central coil spring 42 for urging the battery cells 28 forwards such that the front battery cell 28 will have its front end bearing against the rear cap 54 behind the light bulb 50 and its anode coming into contact with the end terminal of the light bulb 50 through the rear cap 54. The coil spring 42 also electrically connects the cathode of the rear battery cell 28 to the tail piece 40, which is in turn in electrical connection with the barrel rear end 24. This arrangement completes the power supply circuit of the light bulb 50.

The light bulb 50 extends forwards into the cup reflector 34 for its light to be beamed out through the glass plate 32. Rotation of the head cap 30 enables focusing of the light beam. When the head cap 30 is screwed tight to the barrel front end 22, the rear end of the cup reflector 34 will push the rear cap 54 slightly backwards, thereby separating the anode of the front battery cell 28 from the end terminal of the light bulb 50 and thus switching off the light bulb 50.

The barrel 20 has an outer surface which is slightly curved and converging towards its rear end 24. The tail piece 40 has a generally conical outer surface which lies forwardly flush with that of the barrel rear end 24 to form a smooth outer shape at the rear end portion of the flashlight 10. The tail piece outer surface is also curved and converging backwards, at a gradually increasing angle, to form a rear-most pointed end 44 which is rounded and almost sharp.

The pointed end 44 and the converging profile of the tail piece 40 and barrel 20 make it easy and convenient for the rear end portion of the flashlight 10 to be planted or stuck into a penetratable supporting surface, such as soil, a wall or the sand of a beach, for standing on it own in a stable manner. The outer surface of the head cap 30 also lies flush with that of the barrel front end 22. Both the head cap 30 and the tail piece 40 are not clearly distinguishable from the barrel 20. The flashlight 10 thus has a smooth overall outer shape like a bullet.

The light bulb 50 will be switched on when the head cap 30 is loosened and will stay on when the head cap 30 is fully unscrewed and removed, resulting in a condition in which the light bulb 50 is completely exposed and shines all around like a candle. This condition is suitable for general illumination, particularly when the flashlight 10 is standing on its own as described above.

Figure 2:
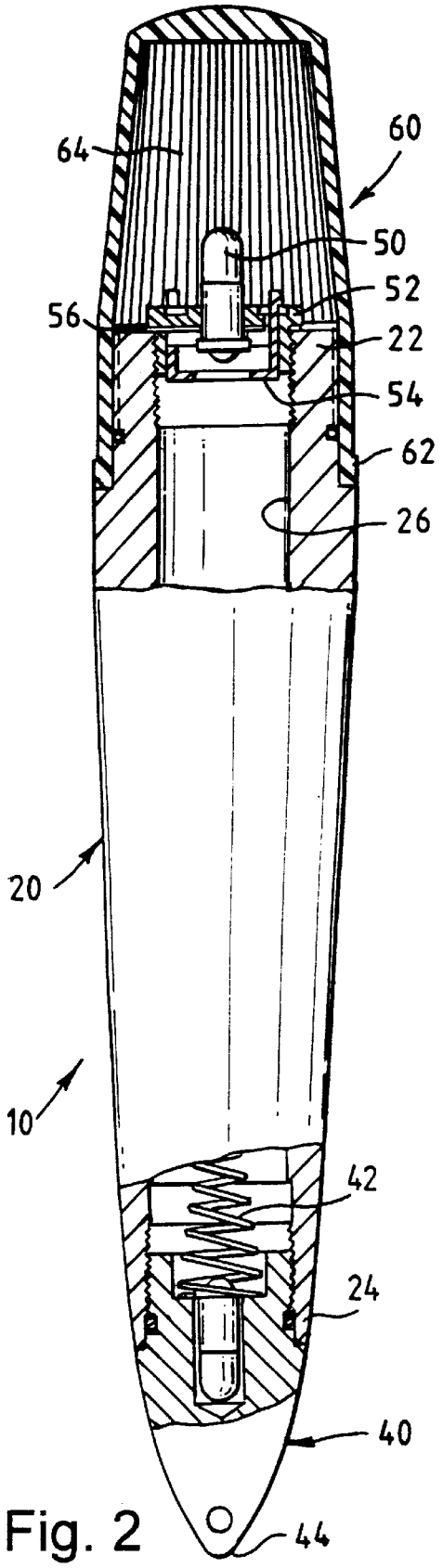
FIG. 2 is a cross-sectional side view of the flashlight of FIG. 1, showing the use of a shade in place of the head-piece.
Figure 3A:
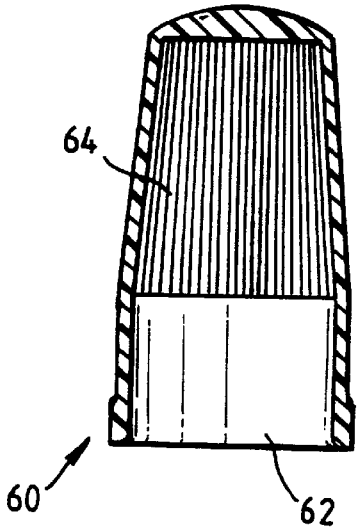
FIG. 3A is a cross-sectional side view and FIG. 3B is a bottom plan view of the shade of FIG. 2.
Figure 3B:
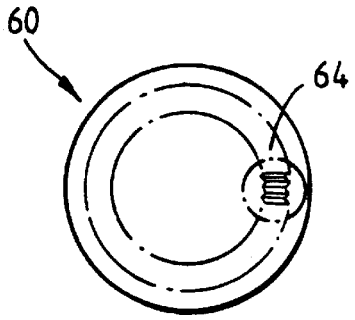

As shown in FIGS. 2, 3A, and 3B the flashlight 10 includes a cap-like plastic shade 60 for replacing the head cap 30, as desired for general illumination when the light bulb 50 is on. The shade 60 has a single open end 62 for fitting by friction over the exposed barrel front end 22 to surround and cover the light bulb 50, and includes a transparent or translucent wall 64, whether colored or not, having both inner and outer surfaces formed, such as serrated as shown or otherwise ribbed or dimpled, for diffusing the light of the light bulb 50. The shade 60 is useful to provide a soft lighting effect and an expanded light source, like a torch, particularly when used as an alert or panic signal.

In a different embodiment, a built-in shade, equivalent to the add-on shade 60, may be adopted. For example, such a shade may be provided by an intermediate section of the peripheral wall of the head cap 30, at a position between the cup reflector rear end and the head cap screw threaded end, made of transparent or translucent plastic material for revealing the light bulb 50 sideways when the modified head cap is sufficiently unscrewed.

Figure 4:
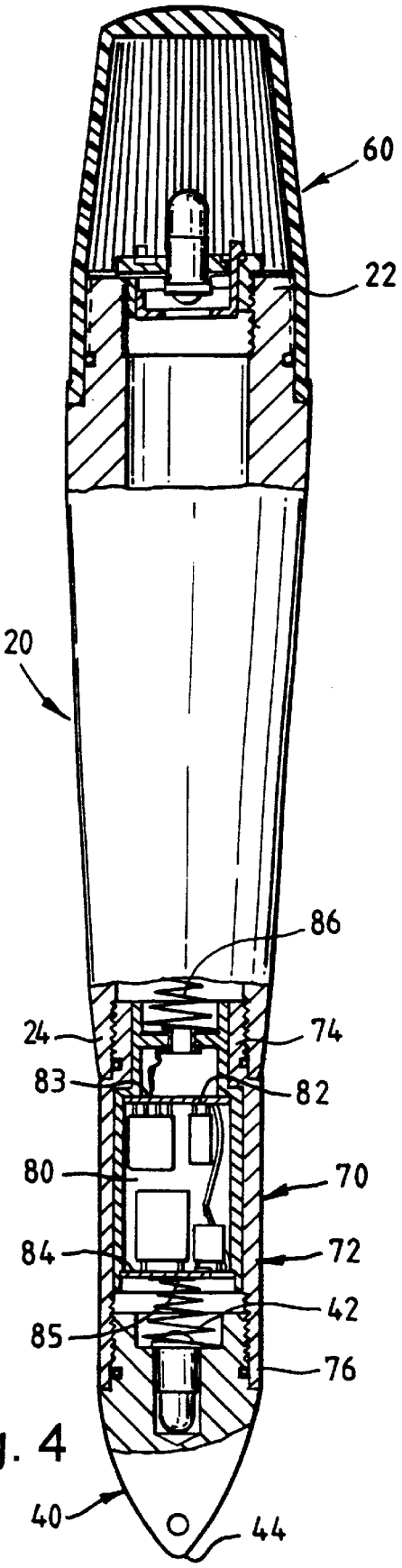
FIG. 4 is a cross-sectional side view of the flashlight of FIG. 2, showing the use of an add-on control unit for flashing.

Reference is finally made to FIG. 4 of the drawings. The flashlight 10 may include a control unit 70 for controlling the light bulb 50 to flash. The control unit 70 is in the form of an add-on body section for use between the barrel 20 and the tail piece 40. It has an aluminium cylindrical body 72 which has a front end 74 externally screw-threaded for connection into the barrel rear end 24 and a rear end 76 internally screw-threaded for connection onto the tail piece 40. The body 72 completes the electrical connection between and has outer shape and size matching with those of the barrel 20 and tail piece 40 at opposite ends.

The control unit 70 incorporates an electronic control circuit 80 formed by front and rear printed circuit boards 82 and 84 supporting various electronic components to form a standard switching circuit. The circuit boards 82 and 84 have respective contacts 83 and 85 acting as two terminals of the control circuit 80. The front terminal 83 is electrically connected to a central conductive coil spring 86 located by the body front end 74 to project forwards. The rear terminal 85 is positioned centrally and facing outwards through the body rear end 76.

The barrel 20 and tail piece 40 must first be unscrewed apart for the control unit 70 to be joined and used between them. In this lengthened configuration, compared with the original configuration (FIGS. 1 and 2), the tail piece coil spring 42 urges against the control unit rear terminal 85 (instead of the cathode of the rear battery cell 28) and the control unit coil spring 86 urges against the cathode of the rear battery cell 28.

The control circuit 80 is therefore readily connected, electrically in series, into the power supply circuit of the light bulb 50. In operation, the control circuit 80 makes and breaks the circuit connection between its two terminals in order to switch on and off the light bulb 50 repeatedly for flashing. The flashing pattern may, for example, be in the form of "- - - — — — - - -" for representing a conventional S.O.S. distress signal.

The invention has been given by way of example only, and various modifications of and/or alterations to the described embodiment may be made by persons skilled in the art without departing from the scope of the invention as specified in the appended claims.

What is claimed is:

1. A flashlight comprising a elongate body for containing a battery cell and having front and rear ends, a light bulb supported at the body front end, a head piece connected to the body front end for covering the light bulb, a tail piece having an outer shape converging backwards to form a substantially pointed end such that the flashlight may be planted or stuck into a penetratable supporting surface for standing on its owns, and a control unit incorporating an electronic control circuit for switching the light bulb on and off to flash, the control unit being detachably disposed between the body rear end and the tail piece and having terminals on opposite ends thereof for ready electrical connection to the body rear end and the tail piece into a power supply circuit of the light bulb.

2. A flashlight as claimed in claim 1, wherein the tail piece has a substantially conical outer shape.

3. A flashlight as claimed in claim 1, wherein the tail piece and the body rear end have a smooth overall outer shape.

4. A flashlight as claimed in claim 3, wherein the tail piece, the body and the head piece have a smooth overall outer shape.

5. A flashlight as claimed in claim 1, including a shade for surrounding the light bulb.

6. A flashlight as claimed in claim 5, wherein the shade is adapted to be connected to the body front end in place of the head piece.

7. A flashlight as claimed in claim 6, wherein the shade is adapted to be fitted by friction over the body front end.

8. A flashlight as claimed in claim 5, wherein the shade has a transparent or translucent wall having a surface formed to diffuse the light of the light bulb.

9. A flashlight as claimed in claim 8, wherein the surface of the shade is serrated.

10. A flashlight as claimed in claim 1, wherein the control unit has a first end connected to the body rear end and having an outer shape and size matching those of the body rear end where the body rear end is connected to the first end, and a second end connected to the tail piece and having an outer shape and size matching those of the tail piece where the tail piece is connected to the second end.

* * * * *